United States Patent [19]

Poloni

[11] Patent Number: 4,726,108

[45] Date of Patent: Feb. 23, 1988

[54] DEVICE TO REPLACE ROLLS AND APPARATUS ON ROLLING STANDS HAVING ROLLS SUPPORTED AT ONE END

[75] Inventor: Alfredo Poloni, Ronchi Dei Legionari, Italy

[73] Assignee: Danieli & C. Officine Meccaniche SpA, Buttrio UD, Italy

[21] Appl. No.: 903,871

[22] Filed: Sep. 2, 1986

Related U.S. Application Data

[63] Continuation of Ser. No. 668,019, Nov. 5, 1984, abandoned.

[30] Foreign Application Priority Data

Nov. 11, 1983 [IT] Italy ..... 83497 A/83

[51] Int. Cl.[4] ..... B25B 27/14

[52] U.S. Cl. ..... 29/281.1; 72/239

[58] Field of Search ..... 72/239; 29/281.1; 269/46

[56] References Cited

U.S. PATENT DOCUMENTS

| | | | |
|---|---|---|---|
| 269,573 | 12/1882 | Haskin | 72/239 |
| 1,712,575 | 5/1929 | McArthur | 72/239 |
| 3,425,256 | 2/1969 | McGoogan et al. | 72/239 |
| 3,593,555 | 7/1971 | Grosko | 72/239 |
| 4,090,388 | 5/1978 | Pim | 72/239 |
| 4,471,642 | 9/1984 | Wilson | 72/239 X |
| 4,522,051 | 6/1985 | Hayashi et al. | 72/239 X |

FOREIGN PATENT DOCUMENTS

| | | | |
|---|---|---|---|
| 1545751 | 11/1968 | France . | |
| 146411 | 9/1982 | Japan | 72/239 |
| 103904 | 6/1983 | Japan | 72/239 |
| 1508599 | 4/1978 | United Kingdom . | |

*Primary Examiner*—Robert C. Watson

*Attorney, Agent, or Firm*—Wegner & Bretschneider

[57] ABSTRACT

This invention concerns a device (10) to replace rolls (11) and/or apparatus (12) on rolling stands (25-26) having rolls (11) supported at one end, which device is able to cooperate with static support stand means (28-48) and is moved by crane or bridge crane means, possibly with a rotatable turret (33), and comprises frame means (110) with hook means (23), jaw means (16) with means (20) to engage rolls, and actuation means (17), such device comprising also means (22) to engage apparatus, the reciprocal positioning of parts (11-12-13) when engaged by such device (10) being substantially the same as the reciprocal positioning of such parts (11-12-13) when fitted to the rolling unit (25-26).

20 Claims, 14 Drawing Figures

DEVICE TO REPLACE ROLLS AND APPARATUS ON ROLLING STANDS HAVING ROLLS SUPPORTED AT ONE END

This application is a continuation application of U.S. application Ser. No. 668,019, filed Nov. 5, 1984, now abandoned.

This invention concerns a device to replace rolls and apparatus on rolling stands having rolls supported at one end.

To be more exact, the invention concerns a device or equipment able to grip together the rolls of a rolling stand, whether the stand is horizontal or vertical, and also the apparatus or guides for the rolled product and the means which support such apparatus.

It is possible in this way to withdraw such components en bloc at one and the same time, for instance, so as to replace them or for maintenance or to change the type of rolled product to be produced.

According to variants of the invention it is also possible to remove or position the rolls alone or the apparatus alone or else the rolls together with the apparatus, the components being removed or positioned with their reciprocal spacing and alignment maintained as in their working position.

There exists in the known art equipment to carry out the changing of the sets of rolls of a rolling stand having rolls supported at one end. Such known equipment engages only the two rolls and leaves the apparatus and relative supports in position.

The apparatus and supports are removed separately by hand or in other known ways.

According to the known art, it is possible to engage one roll at a time or two rolls at a time by means of such equipment, which is moved by a crane or bridge crane or the like.

For instance, French patent No. 1,545,751 (VEB) discloses a movable device able to remove rolling rolls from stands supported at one end and to place them on static support stands, and viceversa.

In fact, a hydraulic gripper is envisaged which is able to engage the top of the cylinder to be removed. This French patent envisages the engagement and movement of one single roll at a time. There are therefore no means able to engage the whole set of rolls and relative apparatus. Movement is carried out by means of a bridge crane type with a rotatable turret.

U.K. patent Specification No. 1,508,599 (British Steel Corporation) discloses a device to handle heavy rolls, the device being hung from a crane or bridge crane for movement. Such device comprises fingers with annular protrusions able to grip the roll in correspondence with on of the grooves which shape the rolled bars. The device is actuated by hand and can remove and handle one single roll at a time; in practice, the device is a large gripping device with several jaws.

As indicated above, the known methods for replacing rolls and apparatus envisage that this operation is performed in at least two steps, the rolls being withdrawn separately from the apparatus. This fact entails a considerable waste of time.

Moreover, each element to be fitted has to be aligned in relation to the other elements and therefore this operation requires a successive considerable waste of time and also personnel to carry it out.

Likewise, removal of the rolls and apparatus takes place, in the known art, in an uncorrelated manner and such components are then deposited in a haphazard way.

Thus it is always necessary at a later stage to take the components one by one for re-fitting to the rolling stands thereafter.

The present invention has the purpose of introducing a new device to carry out replacement of rolls and apparatus of rolling stands with maximum simplicity and speed.

This invention envisages a device able to clamp not only the two rolls but also the apparatus and relative supports for withdrawal from the rolling stand at one and the same time.

So as to simplify the operation of replacement of rolls and apparatus, the invention arranges to position beforehand, in an accessible place near enough to the rolling stand to be serviced, a stand which serves as a static support for a set of rolls and apparatus.

Such rolls and apparatus are positioned mutually spaced apart and aligned, being already engaged by the device of the invention.

The rolls and apparatus in this way are taken already clamped by the device of the invention and already geometrically pre-arranged in relation to each other.

Thus only a simple positioning on the rolling stand is needed so as to have the components ready to start working after they have been fastened to the rolling stand.

Likewise, removal of the rolls and apparatus from the rolling stand is performed with the device of the invention in such a way that the rolls and apparatus can be deposited on the support stand with the device of the invention.

According to the invention two or more such devices can be envisaged, of which one serves to withdraw a set of rolls and apparatus and to place it on a support stand, whereas another serves to take another set of rolls and apparatus from a support stand and to position it on a rolling stand.

The device of the inventiion comprises an engagement and alignment means with pre-set jaws able to engage at the same time the rolls and the support of the apparatus to which such apparatus is solidly fixed. Such rolls and support have suitable engagement and abutment profiles.

In this way, as stated earlier, the rolls, apparatus and support of the apparatus can be withdrawn at one and the same time after they have been engaged.

According to variants of the invention it is possible to envisage devices able to take the rolls alone or apparatus and relative support alone, depending on the conformation given to the movable jaws.

According to a further variant two independent pairs of jaws can be visualised, of which a first pair is able to take the rolls alone, whereas another pair can take the apparatus and support of the apparatus alone; in this way it is possible to withdraw the rolls or the apparatus or all of them as required.

The device of the invention is moved, for instance, on chains fitted to a bridge crane or other equivalent means.

The device of the invention can be adapted for use with vertical rolling stands and with horizontal rolling stands. In the same way the positioning of the sets of rolls and apparatus on the support stands can be vertical or horizontal.

So as to facilitate positioning on horizontal rolling stand, the invention envisages specific means able to perform at least vertical alignment of the set of rolls and apparatus on a rolling stand. This feature is due to the fact that, when rolls with horizontal axes are being positioned on rolling stands, the displacement of such set of rolls and apparatus for alignment purposes on the rolling stand to which the set has to be fitted is problematical.

According to a variant the invention envisages a method of changing the rolls and apparatus which arranges for the use of a device of the type described above that is able to take and support independently two complete sets of rolls and apparatus/supports.

According to such method of "new" sets to be fitted to the rolling stands are engaged by the device and placed in a waiting station on appropriate conveyor means which cooperate with the rolling stands themselves.

All the rolling stands on which the rolls are to be replaced are thus pre-arranged; such operation can take place while rolling work is in progress.

At the end of rolling work the "old" sets are engaged by the device and withdrawn by displacement of the above conveyor means.

Then the conveyor means move the device of the invention, by rotation for example, and such device supplies to the rolling stand the "new" set which was engaged beforehand, as previously mentioned.

The "new" set is fitted to the rolling stand with a suitable movement, and then the device, holding the "old" set, is moved away and positioned as required, on a support stand for instance.

With such methods of employment of the invention the times for changing the sets of rolls and apparatus are lessened considerably since the "new" sets can be prearranged ready for fitting even during rolling work.

As soon as rolling work stops, the "new" sets are fitted instead of the "old" sets by means of an operation which can be carried out at the same time on all the rolling stands and which can be performed very speedily.

In a further variant of the invention a manipulator is provided which is able to withdraw the device, which has already engaged the rolls and apparatus and is positioned on a support stand, and to place the whole on rolling stands having a vertical or horizontal axis.

The device is then "opened" and releases the rolls and apparatus in their working position and is taken away by the manipulator.

In a preferred embodiment the manipulator has an arm of a telescopic or articulated type that is equipped at its end with means which can engage the gripping and clamping device and which can rotate through 90° for use vertically or horizontally.

The movement of such arm in the working area can be performed by means of a trolley or other means on suspended runways, for instance. Its travel towards the rolling stand can be controlled by hand or automatically. For example, a numerical control of the progress of the manipulator can be visualised.

It is also possible to envisage a robot able to learn the positioning cycle automatically.

Fine positioning and alignment of the set of rolls and apparatus on the rolling stand have to be performed within limited tolerances and will be subject in this case to precision control means such as laser-type aligners or aligners of another type.

The invention is therefore embodied with a device to replace rolls and/or apparatus on rolling stands having rolls supported at one end, which device is able to cooperate with static support stand means and is moved by crane or bridge crane means, possibly with a rotatable turret, and comprises frame means with hook means, jaw means with means to engage rolls, and actuation means, such device being characterized by comprising also means to engage apparatus, the reciprocal positioning of parts when engaged by such device being substantially the same as the reciprocal positioning of such parts when fitted to the rolling unit.

There is described, as a non-restrictive example, some preferred embodiments of the invention with the help of the attached figures, in which.

Figure 2:
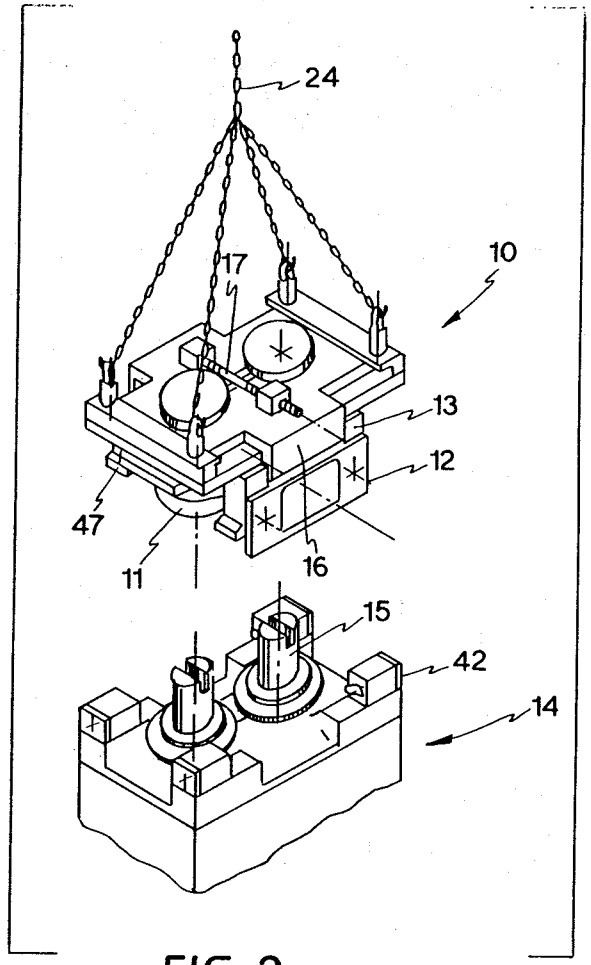
FIG. 2 shows the engagement of the rolls and apparatus and their withdrawal from the rolling unit by the device.

In FIGS. 1 to 4 inclusive a device 10 to replace rolls and apparatus has a frame 110 with a substantially rectangular or quadrangular shape. In this case the frame 110 has at its four corners anchorage hook means 23 which enable the frame 110 to be lifted, by chain means 24 in this example, so that the device 10 can be moved inside the shed where the rolling units to be serviced are lodged.

In this case the device 10 has two opposed jaws 16 which can slide within guide means, or guides, 46. The jaws 16 can be actuated so as to move in the direction of their closure or opening by screw-threaded means 17.

In this instance the screw-threaded means 17 are operated by hand with a suitable pneumatic tool 18, but according to the invention the means 17 which actuate the jaws 16 can be envisaged as being solidly fixed to the frame 110 of the device 10.

Each jaw 16 has profiles 20 suitable for engaging rolls. In the example shown such profiles 20 have shapings able to cooperate with circumferential grooves 19 machined at the top of the rolls 11.

However, it is possible to obtain such cooperation in a manner other than that shown; for instance, the rolls 11 can be provided with anchorage means shaped at their upper part or with holes or hollows or projections, however arranged, the engagement profiles 20 being shaped correspondingly. But the embodiment shown possesses great simplicity of practical embodiment.

At their lower portion the jaws 16 comprise lower engagement profiles 22, of which the surface facing towards the inside of the jaws 16 are conformed here with an inclined plane so as to cooperate with corresponding profiles 21 positioned on opposite sides of a support 13 for apparatus.

Figure 1:
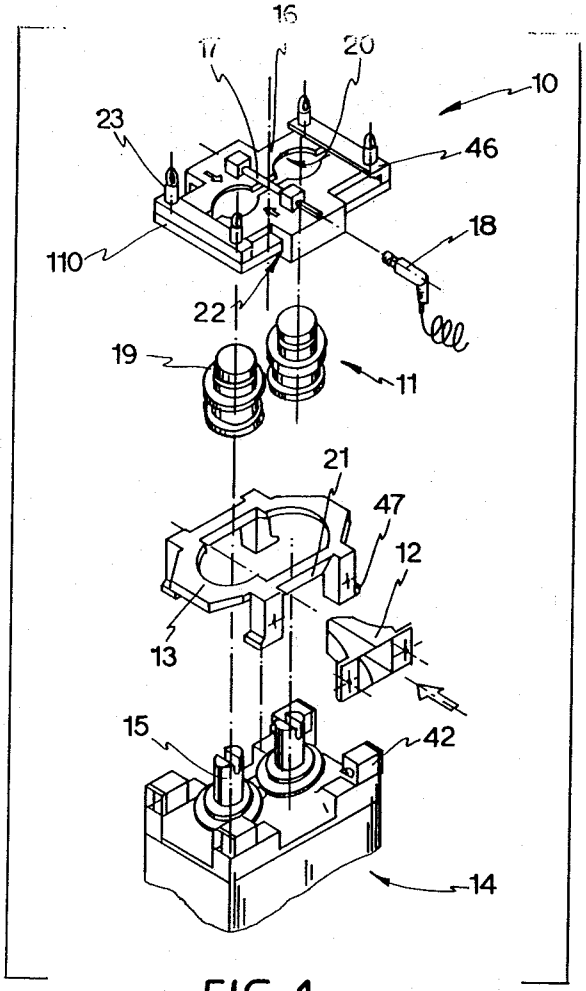
FIG. 1 is a knocked-down view of the reciprocal positioning of the parts on a rolling unit, and also of the device of the invention shown above such parts.

FIG. 1 shows one apparatus or guide 12 separated from the support 13 to which it is normally secured with bolts.

FIG. 2 shows the operation of widthdrawal of the whole set of rolls 11/apparatus 12/apparatus support 13, hereinafter called "set", by means of the device 10.

The jaws 16 are closed by the screw-threaded means 17 and thus clamp between them the rolls 11 and apparatus support 13.

FIGS. 1 and 2 show a base 14 of a rolling unit from which shafts 15 of the rolls 11 protrude.

Clamp means 42 are provided on the base 24 so as to obtain speedy anchorage and release of the apparatus support 13 and consist of blocks able to slide and equipped with suitable alignment abutments in this instance. These alignment abutments engage feet 47 protruding from the support 13.

The clamp means 42 can be operated by a screw or pneumatically or hydraulically or by any other type of means, but the clamp mens 42 can also be envisaged as being of another known type.

In the example shown the engagement device 10 is moved by means of a chain 24 suspended from a crane or bridge crane 27 or means of another type.

In this way the device 10 can be moved within the shed in which are located vertical rolling units 25 or horizontal rolling units 26.

Figure 3:
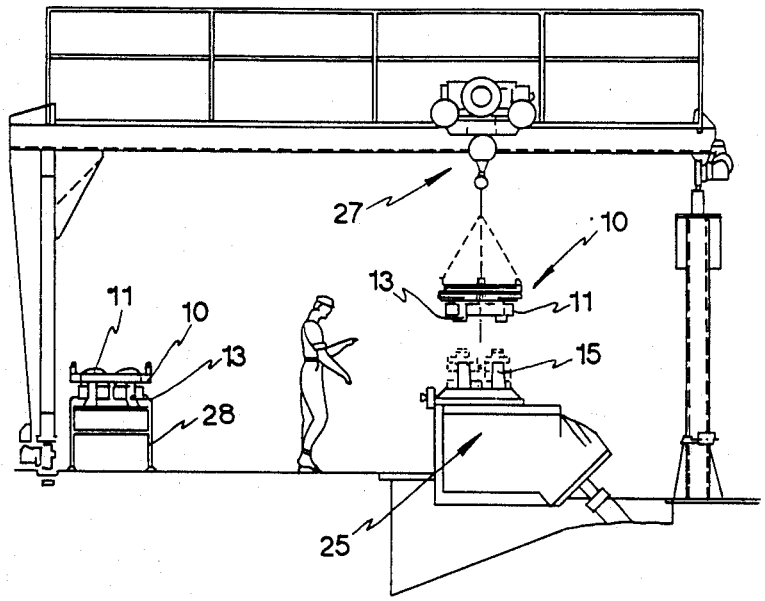
FIGS. 3 and 4 show the movement of the device to service vertical and horizontal rolling units.

FIG. 3 shows a vertical unit 25 which is serviced by the device 10.

The rolls 11 and apparatus support 13 can be seen engaged by the device 10 and withdrawn from the rolling unit 25 on which they occupy the position drawn with lines of dashes.

In a position in front of the rolling unit 25 can be seen a support stand 28 on which is positioned a set already engaged by the device 10.

The apparatus or guides 12 (see FIGS. 1 and 2) solidly fixed to the support 13 are not shown in FIG. 3.

The rolls 11 with the apparatus 12 and apparatus support 13 are aligned on a support stand 28 by the device 10 in a layout identical to their working lay-out. It is thus enough to take the set clamped by the device 10 and to fit it to the rolling unit 25 without any problems of reciprocal alignment of the parts thus taken.

In the example of FIG. 3 the alignment of the set of rolls and apparatus on the rolling unit takes place by hand, the flexibility of the chain 24 enabling a fine displacement of the device 10, together with the set engaged by the device 10, to be performed by hand. Alignment is facilitated by the taper of the shafts 15.

Figure 4:
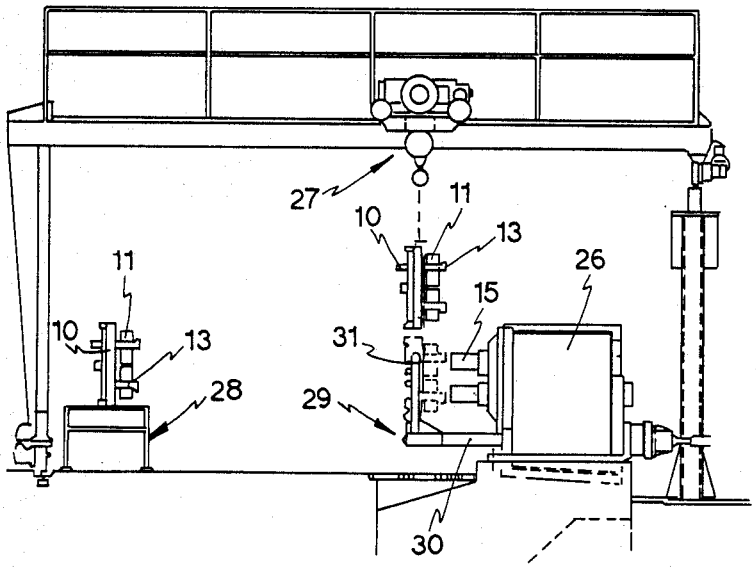

FIG. 4 shows how the device 10 holding the rolls 11 and apparatus support 13 is employed together with a horizontal rolling stand 26 of which the roll-bearing shafts 15 can be seen.

In this case, if the alignment is carried out by hand, it is harder since it is difficult to adjust the vertical and lateral positions of the rolls 11 accurately for a proper alignment. Vertical alignment of the rolls 11 on their shafts 15 is particularly hard.

A support and alignment means 29 is provided for this purpose and is positioned below the rolling unit 26 and comprises in this example one or more retractable rods 30 to which fork-wise prongs 31 are connected.

Such a means 29 obtains accurate positioning of the device 10 in relation to the shafts 15 of the rolls 11. In fact, the means 29 is equipped with horizontal and vertical abutment surfaces which cooperate with corresponding abutment surfaces on the device 10.

When the device 10 has been positioned by hand on the support and alignment means 29, the retraction of the means 29 positions the rolls 11 easily on their respective shafts 15, the rolls 11 being brought to their correct position in relation to the shafts 15.

So as to position the set of rolls 11, apparatus 12 and support 13 on a horizontal rolling stand 26, the device 10 is suspended on its side, as can be seen in FIG. 4. Such suspension can take place, for instance, by providing the device 10 with lateral hooks.

The support stand 28 too of FIG. 4 is equipped for such sideways arrangement of the device 10.

It is possible to alternate more than one device 10 for servicing the rolling units 25 or 26; for example, while one of the devices 10 carries out withdrawal of the rolls 11 from a rolling stand 25 or 26, another device 10 can be supported by an appropriate trolley or the like and can take the spare set from the corresponding support stand 28.

In this way the first device 10 is placed on the support stfand 28 together with the rolls 11 and apparatus support 13, while the second device 10 moves the set taken from the support stand 28 and places it on the rolling stand to be serviced, whether the latter is horizontal 26 or vertical 25.

FIGS. 5 to 9 inclusive show a variant of the invention which envisages a "double" device 210 consisting in practice of two type-10 devices positioned as counterparts to each other and solidly fixed together in this case.

The device 210 is normally disposed on a support stand 48 (see FIG. 8) with the axes of the rolls 11 positioned horizontally.

The device 210 is taken by being hooked by a conveyor means 49, which in this example is like a bridge crane and in which a trolley 149 bears a column 50 that is able to move vertically.

In the figure the device 210 is hung at the lower end of the column 50 on hooks 150 of a plate means or plate 250.

The plate 250 in turn is articulated on the bottom of the column 50 with short arms or links 45, which permit the plate 250 to swing in a plane perpendicular to the plane of swinging of the hooks 150, as can be seen in the figure.

In this way there is articulation in two planes, a condition which facilitates the positioning of the device 210, as will become evident hereafter.

So as to change rolls 11 on a horizontal rolling stand 26, the device 210 together with the "new" set is laid and inserted onto a positioner means 129 like the support and alignment means 29 but provided with a rotatable fork means 51.

Figure 6:
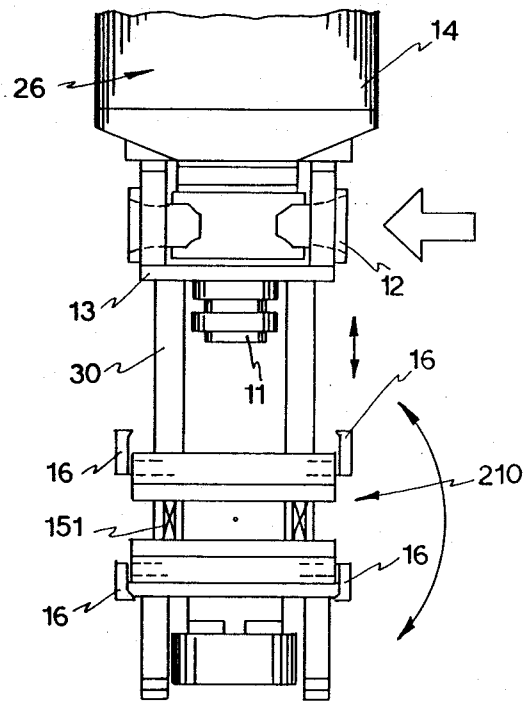
FIGS. 5 to 9 show a variant of the device of the invention.

Cooperation between the fork 51 and the device 210 takes place as in FIG. 6. Two prongs 151 are introduced into corresponding seatings in the device 210. Such introduction is faciltated by lead-in top portions of the prongs 151 with a pyramidal or tapered or other suitable shape.

Such lead-in portions enable the device 210 to be positioned easily by means of the column 50 by virtue of the articulated joint consisting of the hooks 150 and links 45; the ability of the device 210 to swing horizontally facilitates its alignment by the lead-in top portions of the prongs 151 and therefore its installation on the positioner means 129.

The device 210 is positioned as in FIG. 6, where it is shown in a plan view, and is unhooked from the column 50.

The "new" set is turned outwards, while the "old" set is still on the rolling stand.

So as to replace the "old" set with the "new" set, the positioner means 129 are retracted and the device 210 is secured to the "old" set. The whole is then moved away from the rolling stand by sliding towards the outside of the positioner means 129.

Both the sets are thus engaged by the device 210 supported by the fork 51. The latter 51 is then rotated by 180° and brings the "old" set outwards in this way in relation to the rolling unit, or rolling stand, 26 and brings the "new" set to face the rolling stand 26.

The positioner means 129 is then brought close to the rolling stand 26 again; when the rolls 11 have been secured to their respective shafts 15 and the support 13 has been anchored to the base 14, the device 210 is disengaged (by opening the relative jaws 16) from the "new" set which is now ready to work.

The positioner means 129 are moved away from the rolling stand 26 once again.

At any time thereafter, even after the resumption of rolling work, the device 210 is re-attached to the column 50 and removed from the fork 51.

Figure 8:
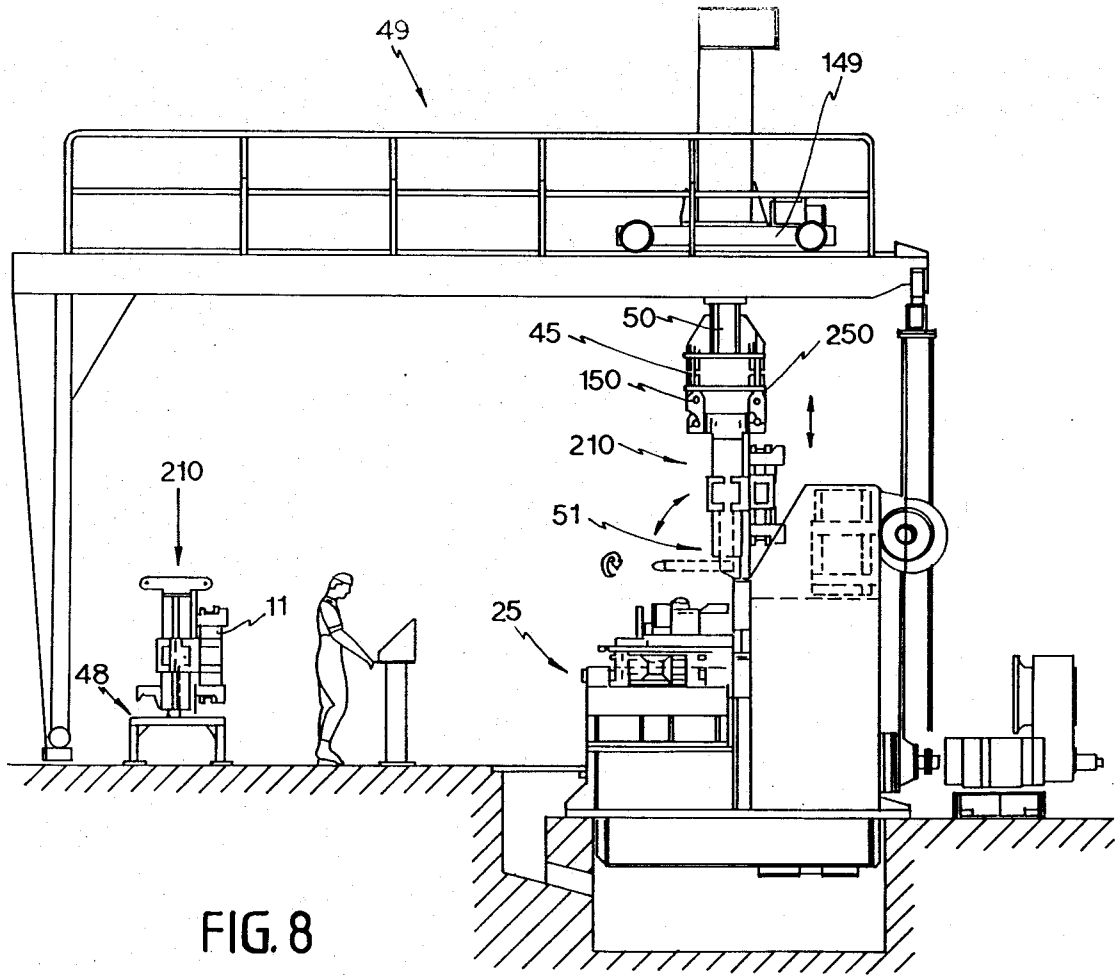

The device 210, still engaged with the "old" set, can be placed on the support stand 48 (FIG. 8).

Figure 5:
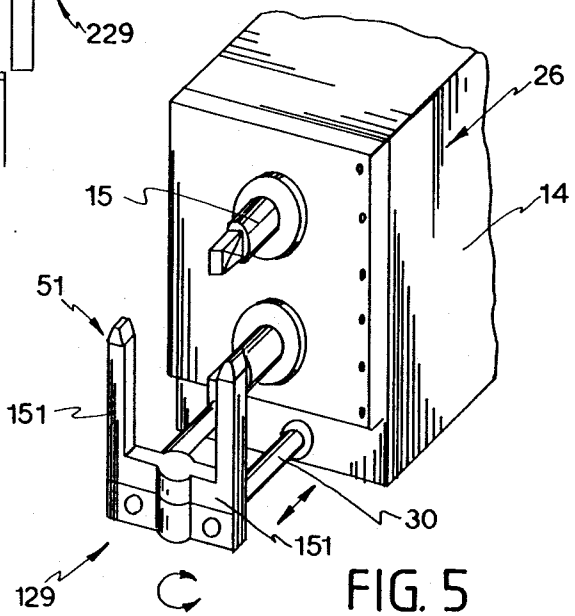
Figure 7:
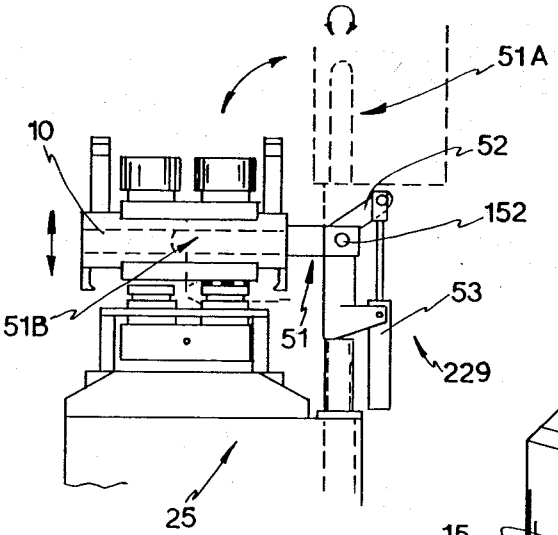
Figure 9:
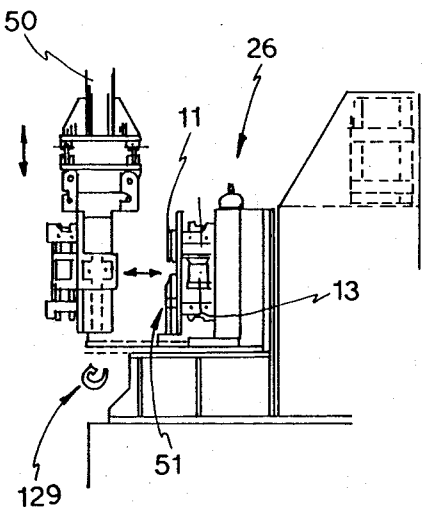

So as to employ a device 210 on vertical rolling units 25, one embodiment of the invention (FIG. 7) envisages positioner means 229 having a vertical travel, together with a rotatable fork 51 like that of FIGS. 5 and 6 but supported by a support arm 52.

The support arm 52 can rotate about an axis 152 and is driven by an actuator, which in this case is a jack 53, or may possibly be moved by hand.

The fork 51 receives the device 210 holding the "new" set at a vertical position 51A; it is then rotated by 90° (position 51B) and brings the device 210 to a cooperation position above the rolling stand 25.

The positioner means 229 are then brought close to the rolling stand 25 and the "old" set is taken by the device 210.

The means 229 are next moved away again by sliding upwards and the fork 51 is turned back to 51A, is then rotated by 180° and is brought back again to 51B.

The device 210 now holds the "old" set upwards and the "new" set downwards towards the rolling stand 25.

The positioner means 229 are then lowered and the "new" set is released and is ready to work as soon as it has been secured to the rolling stand 25.

The means 229 are moved away and the fork 51 is brought back to 51A with the device 210. The latter 210, holding the "old" set, can be withdrawn by the conveyor means 49 and placed on the relative support stand 48.

Such replacement of rolls 11 and/or apparatus 12 can be carried out at the same time on all or on some of the rolling stands 25–26 of a rolling line and will thus lead to a great saving of time as compared to known methods. This is so because the "new" sets can be pre-arranged as required on the forks 51, for example while rolling work is in progress, and the replacement therefore takes place with all the various "new" sets already positioned on the forks 51 of the various rolling stands 25–26.

The conveyor means 49 can be embodied with a manual control or preferably with a numerical control and with automatic positioning above the fork 51.

The trajectories to be followed for the conveyor means 49 to service the various rolling units 25–26 can be stored in appropriate control means.

Selection of the rolling units 25–26 to be serviced can be performed, for instance, with a numbered keyboard, numbers being given to the various units in the rolling line.

FIGS. 10 to 14 inclusive show a further variant of the invention. In this variant a device 10 cooperates with a manipulator means 32, called "manipulator" hereafter.

This manipulator 32 has an arm which can be telescopic, as in the figures, or possibly be articulated.

The manipulator 32 is moved inside the shed by a carriage means, or like means, 127 and can be displaced with a control in three orthogonal directions.

The lower end of the manipulator 32 holds a turret means, or turret, 33. This turret 33 is pivoted at 34 (see FIGS. 12, 13 and 14) and can be rotated by 90° by actuator means 37.

In this case the actuator means 37 comprise one or more hydraulic jacks, but is possible to provide actuator means of a different type comprising, for instance, electric motors or other means.

The turret 33 includes jaws 35, which comprise engagement means 40 able to cooperate with corresponding anchorage means 39 on the frame 110 of the device 10.

Figure 13:
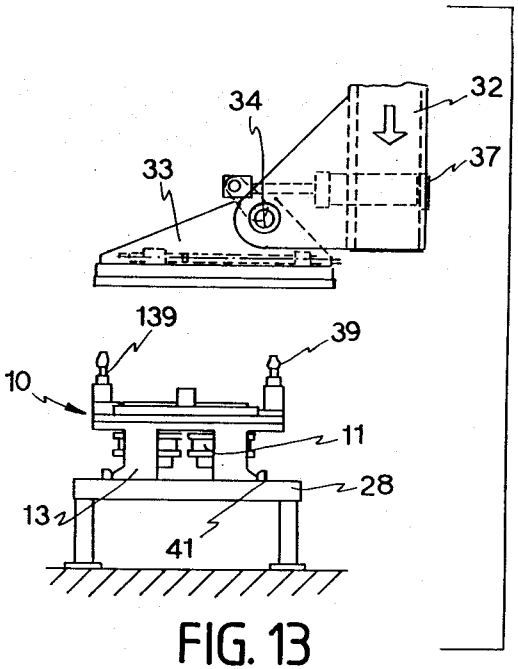
FIGS. 13 and 14 show the method of working of the latter variant.
Figure 12:
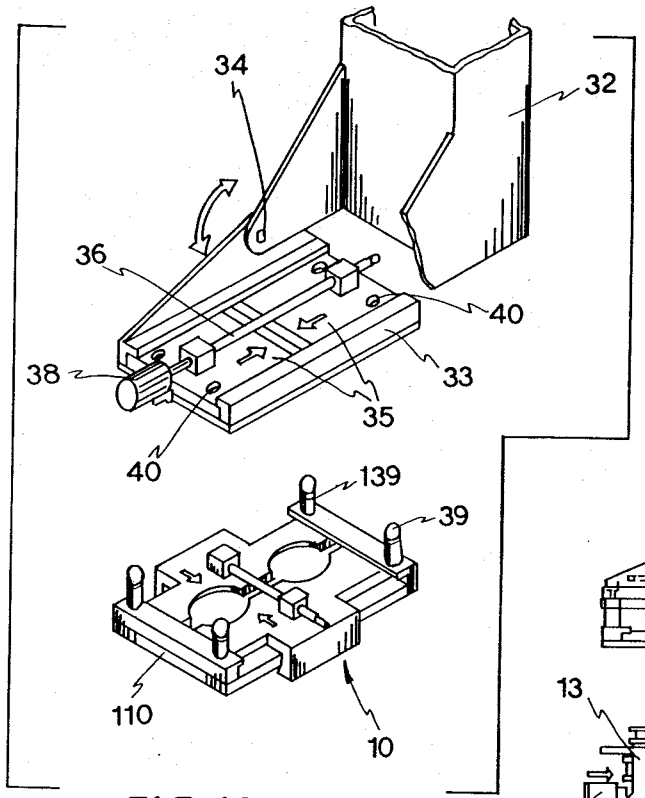

In the figures the anchorage means 39 consist of pins with circumferential engagement grooves 139, as can be seen in FIGS. 12 and 13.

The engagement means 40 consist of corresponding holes which allow the pins 39 to pass through and engage the grooves 139 of the pins 39 when the jaws 35 are closed, thus anchoring the device 10 to the turret 33.

In this case the jaws 35 are driven by screw-threaded means 36 like the screw-threaded means 17 already shown on the device 10.

In the example shown such means 36 can be driven by an actuator means 38, which here is an electric motor, but it is possible to provide actuator means 38 of any type.

Figure 10:
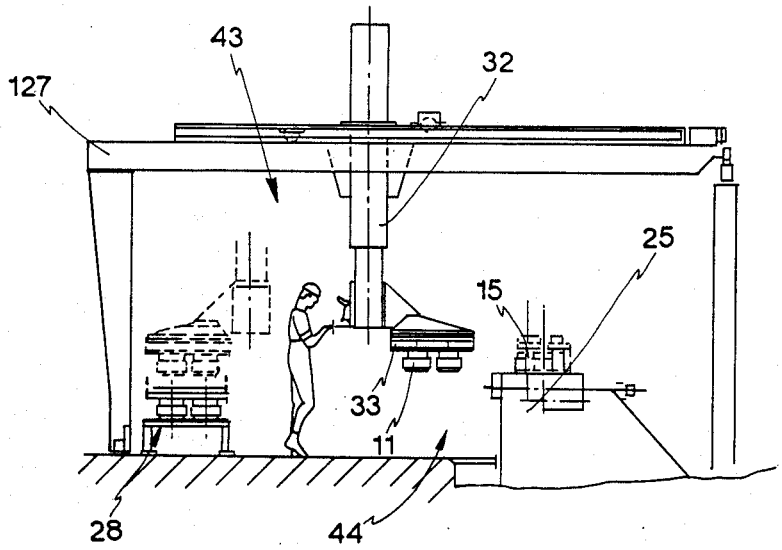
FIGS. 10, 11 and 12 show another variant.
Figure 11:
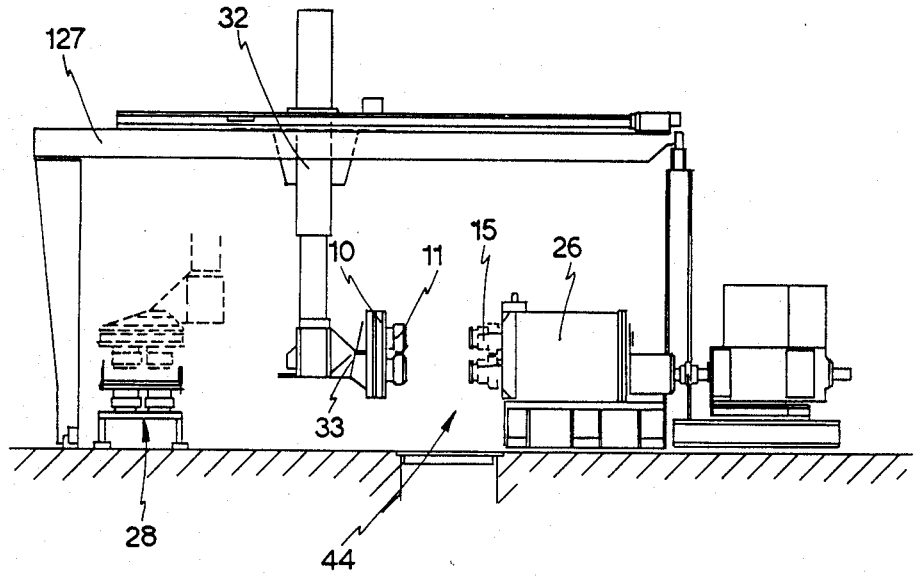

The manipulator 32 works in the following way. The approach of the manipulator 32 to the support stand 28, as shown in FIGS. 10 and 11, or to the rolling stand 25 or 26 is carried out by hand within a manual positioning area 43.

However, it is possible to make this rough positioning take place also in a fully automatic manner.

An automatic positioning area 44 is created near the rolling unit 25 or 26. When the manipulator 32 arrives within this area 44, control of the operation is taken over by automatic control means, such as electronic means, which have the task of aligning precisely the turret 33, which is holding the device 10 together with the rolls 11, apparatus 12 and relative support 13, in correspondence with the shafts 15 of the rolls 11 shown in the figure.

Fine alignment with the shafts 15 of the rolls 11 within the tolerances required can be facilitated with specific alignment means, which are not shown in the figures.

Such alignment means, for instance, can have laser-beam means or other means able to provide a datum of great accuracy so as to obtain correct alignment of the rolls 11 on their shafts 15.

As can be seen in FIG. 10, the withdrawal of the set of rolls 11 and apparatus 12 from the support stand 28 and its positioning on a vertical rolling unit 25 take place with the turret 33 always in a horizontal position.

So as to service a horizontal rolling unit 26, it is advantageously possible to cary out withdrawal from a support stand 28 on which the set, engaged by the device 10, has its axes vertical, as shown in the figure, and thereafter to turn the turret 33 so as to bring the rolls 11 into a horizontal position corresponding with the shafts 15 of the unit 26 (FIG. 11).

In this way the same manipulator 32 can service advantageously not only units 25 with vertical axes but also units 26 with horizontal axes, the sets being always positioned with their axes vertical on the support stands 28 for the sake of convenience.

Figure 14:
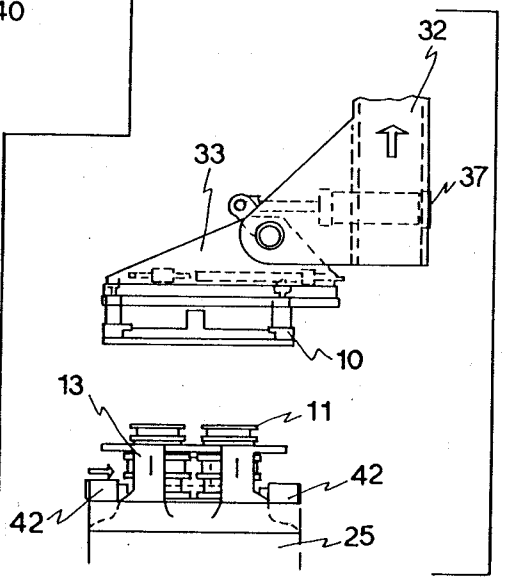

FIGS. 13 and 14 give examples of the working of the maniupulator 32 in cooperation with the device 10.

FIG. 13 shows the removal of the rolls 11 with the apparatus support 13 from the support stand 28 on which they are rested.

The device 10 is already engaged with the rolls 11 and the support 13 on the support stand 28. The manipulator 32, with the turret 33 horizontal, is lowered.

The jaws 35, which at first are in an open position so as to enable the holes 40 to engage the pins 39, are shut so that the holes 40 clamp the pins 39 in correspondence with the circumferential grooves 139.

When the device 10, which is already holding the rolls 11 and apparatus support 13 between its jaws 16, is anchored in this way, the whole assemblage is lifted from the support stand 28 and brought into correspondence with the rolling unit, which is of a vertical type 25 in FIG. 14.

The manipulator 32 is lowered with the device 10 still engaged. When the alignment and positioning of the rolls 11 on their shafts 15 have been carried out with the help of the cited control means such as laser means or the like, the jaws 16 of the device 10 are opened by means of the screw-threaded means 17.

The manipulator 32 is raised and takes with it the device 10, which is now disengaged from the rolls 11 and support 13. The manipulator 32 with the device 10 is moved away from the service area of the rolling unit 25.

The rolls 11 are anchored to their respective shafts 15 and the support 13 of the apparatus 12 is speedily secured in its right position on the rolling unit 25 with the clamp means 42 shown.

There has been described here a preferred embodiment of the device of the invention, but many variants are possible for a person skilled in this field without departing thereby from the scope of the invention.

For instance, it is possible to envisage a different system to move the device 10 of the invention and it is possible to visualise a different manipulator 32 consisting, for example, of an articulated arm or other equivalent means.

The shapes and sizes can also be changed; it is possible to envisage the device 10 of the invention having engagement means and engagement profiles shaped in other ways to engage the rolls and the support of the apparatus.

These and other variants are all possible without departing thereby from the scope of the invention itself.

I claim:

1. A device for replacing rolls, a support means, and a guide on a rolling stand base, said base having roll bearing shafts and having rolls supported to one end thereof, and said support means having engagement profiles and means for anchoring said support to said base; comprising:

crane or bridge means, frame means having means for engagement with said crane or bridge means for moving said device, jaw means, located on said frame means, for engaging said rolls, means for engaging said engagement profiles, located on said frame means wherein said jaws and said means for engaging said engagement profiles are both located on a sliding jaw assembly located on said frame, an actuating means for said jaw means and for said means for engaging, located on said frame means, and wherein said device is configured so that the positioning of said rolls and guide is substantially the same when engaged by said device as when fitted to said rolling stand base roll bearing shafts.

2. The device of claim 1 wherein said crane or bridge means further comprises a rotatable turret.

3. The device of claim 1 further comprising means for the selective engagement of said means for anchoring to said base.

4. The device of claim 3, further comprising actuating means for said jaw means and said means for engaging of said engagement profiles.

5. The device of claim 1, wherein said rolling stand base includes a positioner means.

6. The device of claim 2, wherein said rolling stand base includes a positioner means.

7. The device of claim 3, wherein said rolling stand base includes a positioner means.

8. The device of claim 4, wherein said rolling stand base includes a positioner means.

9. The device of claim 1 including at least two sets of jaw means to engage two sets of rolls and two sets of means for engaging of said engagement profiles.

10. The device of claim 5 wherein said positioner means also are capable of rotating said device.

11. The device of claim 1 in cooperation with at least partially articulated means for movement of said device.

12. The device of claim 2 in cooperation with at least partially articulated means for movement of said device.

13. The device of claim 3 in cooperation with at least partially articulated means for movement of said device.

14. The device of claim 1 in cooperation with substantially rigid crane or bridge means for movement of said device.

15. The device of claim 1, wherein movement of said crane or bridge means occurs in a partially automatic manner.

16. The device of claim 2, wherein movement of said crane or bridge means occurs in a partially automatic manner.

17. The device of claim 3, wherein movement of said crane or bridge means occurs in a partially automatic manner.

18. The device of claim 1, wherein movement of said crane or bridge means occurs by manual control.

19. A device of claim 1 further including a screw threaded actuation means for said jaws.

20. A device of claim 1 wherein said guide is bolted to said support means.

* * * * *